United States Patent [19]

Yang

[11] Patent Number: 4,630,020

[45] Date of Patent: Dec. 16, 1986

[54] PROTECTIVE CIRCUIT BREAKER (I)

[76] Inventor: Tai-Her Yang, 5-1 Taipin St., Si-Hu Town, Dzan-Hwa, Taiwan

[21] Appl. No.: 713,619

[22] Filed: Mar. 19, 1985

[51] Int. Cl.[4] ..... H01H 71/04; H01H 71/16

[52] U.S. Cl. ..... 337/79; 337/68

[58] Field of Search ..... 337/79, 68, 91; 200/151, 314, 61.19, 153 M

[56] References Cited

U.S. PATENT DOCUMENTS

| | | | |
|---|---|---|---|
| 2,254,347 | 9/1941 | Blakesley | 200/151 |
| 3,311,725 | 3/1967 | Butler et al. | 200/61.19 |
| 4,342,979 | 8/1982 | Phillips | 337/79 |

*Primary Examiner*—Harold Broome
*Attorney, Agent, or Firm*—Leonard Bloom

[57] ABSTRACT

A circuit breaker having a manually-resettable handle which extends when the breaker is tripped by a circuit overload. An indicator lamp housed within the handle is lit when an overload condition occurs. The handle also has a lens for allowing light from the lamp to be visible. The far end of the handle has a wedge-shaped member for breaking the main circuit between two main contacts in the circuit breaker when an overload occurs. The wedge-shaped member also has two conductive sheets on its upper and lower surfaces for completing the circuit for the indicator lamp when the overload condition occurs. When the handle moves as a result of a circuit overload, the wedge-shaped member of the handle moves in between the main contacts in the circuit breaker and separates them thereby breaking the main circuits. At the same time that the main circuit contacts are being opened, the conductive sheets on the upper and lower surfaces of the wedge-shaped handle member complete the circuit for the indicator lamp thereby indicating the presence of an overload and a tripped circuit breaker.

2 Claims, 16 Drawing Figures

PROTECTIVE CIRCUIT BREAKER (I)

BACKGROUND OF THE INVENTION

The present invention relates to bi-metallic type circuit breaker which provides a visual indication when the circuit breaker is tripped. A conventional circuit breaker either has a bi-metallic sheet or an electrical coil to break the circuit. The electrical coil type circuit breaker generally also has a manually operated switch. However, the bi-metallic sheet type circuit breaker does not generally have a manually operated switch.

SUMMARY OF THE INVENTION

The improved circuit breaker of the present invention provides a manually operated switch for a bi-metallic sheet type circuit breaker and uses a wedge-shaped handle member to bring about manual control of the circuit. The improved circuit breaker of the present invention also provides an indicator lamp which is operated by said wedge-shaped handle member when the main circuit is tripped. The handle structure of the breaker has an indicator lamp housed therein.

BRIEF DESCRIPTION OF THE DRAWINGS

FIG. 1-1 is a side view in partial cross-section of the embodiment of the invention shown in FIG. 1 taken along line 1-1.

FIG. 1-2 is a close-up view of the circled portion of FIG. 1-1.

FIG. 2 is a top view of another embodiment of the invention having an automatic return feature.

FIG. 2-1 is a side sectional view of the embodiment shown in FIG. 2.

FIG. 3-1 is a side sectional view of the embodiment shown in FIG. 3.

FIG. 4-1 is a side sectional view of the embodiment shown in FIG. 4.

FIG. 5-1 is a side view of the handle shown in FIG. 5.

FIG. 5-2 is a top view of the handle shown in FIG. 5.

FIG. 5-3 is a side sectional view of the handle shown in FIG. 5 taken along line 5-3 in FIG. 5.

FIG. 5-4 is a front view of the handle taken along line 5-4 in FIG. 5.

FIG. 6-1 is a top view of an embodiment of the invention having an indicating lamp provided at the front of the circuit breaker to the side of the handle.

FIG. 6 is the side view of the embodiment shown in FIG. 6-1.

DESCRIPTION OF THE PREFERRED EMBODIMENT

In a typical circuit breaker, the control box, the switch, the circuit breaker element, and the indicating lamp are separate elements. Consequently, the cost of such a circuit breaker is high. Also such a configuration occupies an excessive amount of space in the control box, and the electrical wires are connected manually. Therefore, manufacture of such a circuit breaker is costly and production rates are slow. The present invention provides an integral circuit breaker having the plural functions of a circuit breaker and an indicator for a tripped breaker. The present invention has a handle that can be manually pulled to open or close the main circuit by means of a wedge-shaped member that is inserted between the main contacts to open them.

The wedge-shaped member also has conductive sheets on the upper and lower surfaces, and these conductive sheets complete a lamp circuit when the circuit breaker is tripped for indicating the tripped condition.

Figure 1:
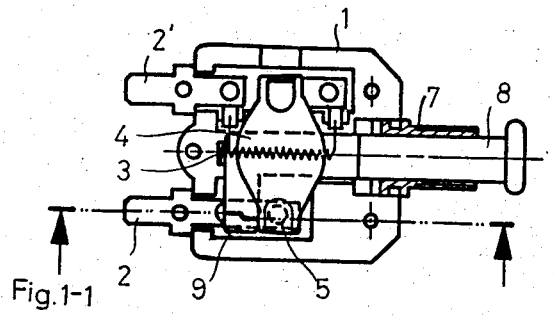
FIG. 1 is a top view of one embodiment of the invention.
Figure 1:
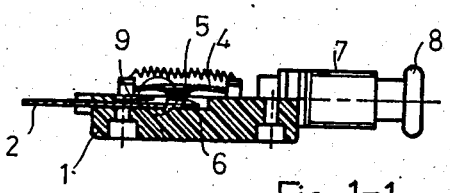

As shown in FIG. 1, element 1 is a housing; elements 2, 2' are conductive connection legs; element 3 is trip spring; element 4 is a bi-metallic sheet; element 5 is a contact point attached on the end of bi-metallic sheet 4; element 6 is a contact point attached on the connection leg 2; element 7 is a fixed screw nut; element 8 is a handle; and element 9 is a wedge-shaped member of handle 8 used for opening and closing the contact points 5 and 6 in order to open or close the main circuit. Elements 10, 10' are conductive sheets on the upper and lower surfaces of the wedge-shaped member 9. Conductive sheets 10, 10' connect with the contacts 5 and 6 when member 9 is wedged in between contact points 5 and 6 in order to supply electric power to an indicating lamp. Element 11 is the indicating lamp bulb. Lamp 11 is preferably housed inside the handle at one end to protect the lamp. Lens 12 may be colored, and light from the indicator lamp 11 shines through lens 12.

Features of the handle 8 are as shown in FIG. 1-1. At the exposed end of the handle 8, there is a relatively large handle bar for manual pushing and pulling the handle.

Wedge-shaped member 9 at the front end of handle 8 is characterized in having an inclined profile which is smaller near contact points 5 and 6 and larger away from contact points 5 and 6.

Figures 1, 2:
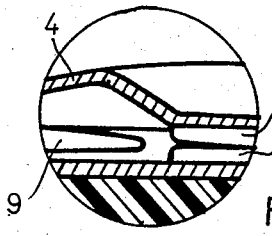
Figure 2:
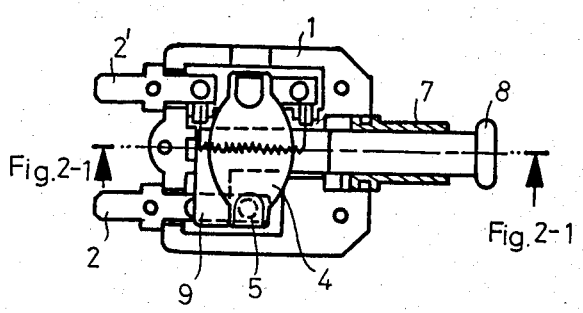
Figures 1, 2:
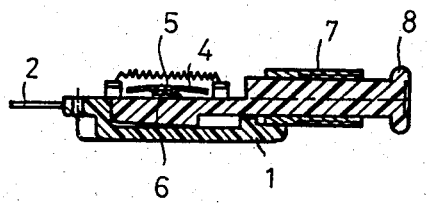

Features of contact points 5 and 6 are as shown in FIG. 1-2.

At the bottom margin of contact point 5 near the coupling surface with wedge-shaped member 9 of the handle 8, there is an opening which is smoothly gradually inclined for receiving the wedge-shaped member 9 when the breaker is tripped.

The oblique angle of wedge-shaped member 9 of handle 8 is larger than the angle of inclination of the opening at the contacts 5 and 6.

The front point of wedge-shaped member 9 is smaller than the outer margin of the opening adjacent to contacts 5 and 6 in order to enable insertion of member 9 between contacts 5 and 6.

The features described above enable wedge-shaped member 9 of handle 8 to be smoothly pushed in between contact points 5 and 6 and pulled out from between contact points 5 and 6 in order to provide OFF and ON action, respectively. Also, in an over-loading condition, member 9 is automatically springed back by elastic force of spring 3 to keep the circuit breaker in the cut-off state.

Figure 3:
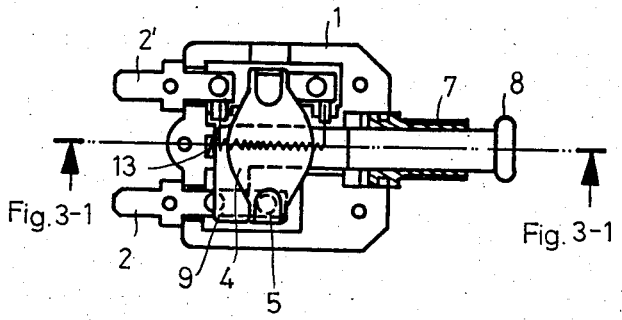
FIG. 3 is a top view of another embodiment of the inventioin having a stabilizing spring in the handle.
Figures 1, 3:
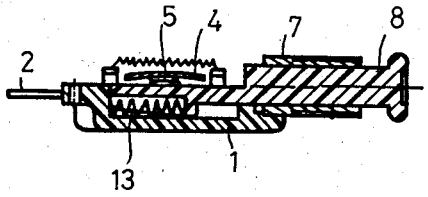
Figure 4:
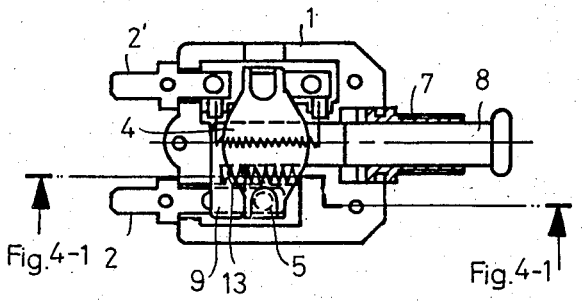
FIG. 4 is a top view of the embodiment of the invention shown in FIG. 3.
Figures 1, 4:
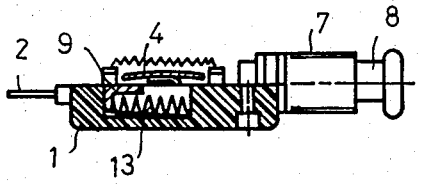

With reference to FIGS. 2 and 2-1, not showing a tension setting spring, or as shown in FIGS. 3, 3-1 and 4, 4-1 showing tension setting spring 13 which can set handle 8, during a condition of over-loading, bi-metallic sheet 4 produces a periodic action of springing open from overheating and then closing after cooling for protection from accidental over-load. This function is the same as the circuit breaker discussed above, and it will not interfere with the operation of manually pulling and pushing to open or close the circuit breaker.

As shown in FIGS. 5, 5-1, 5-2, 5-3, 5-4, the circuit breaker has its indicating lamp 11 housed at the front end of handle 8. Alternatively, the indicator lamp 11 is located in front of circuit breaker, as shown in FIG. 6.

Figure 5:
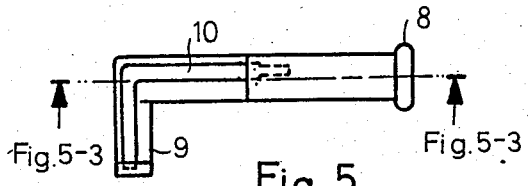
FIG. 5 is a top view of a handle with an indicator made in accordance with the invention.
Figures 4, 5:
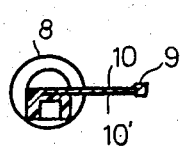
Figures 1, 5:
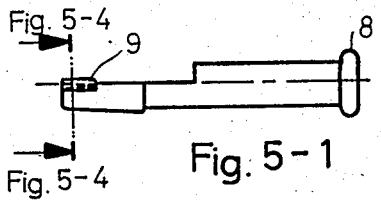
Figures 2, 5:
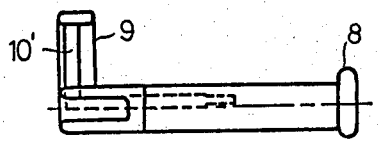
Figures 3, 5:
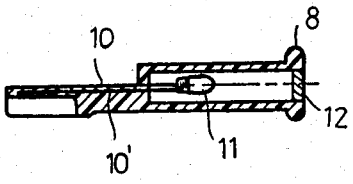
Figures 1, 6:
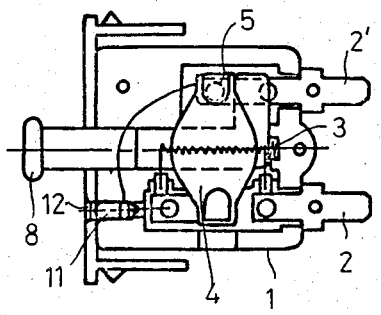
Figure 6:
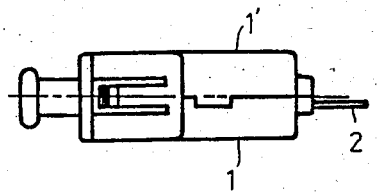

The handle 8 structure shown in FIG. 5, is made from a plastic insulator such as BAKELITE. Contact points 5 and 6 are of a plate type having inclined side walls providing an inner hole at the end near the wedge-shaped member 9.

Element 12 is an indicating lamp cap. It is fixed at exposed end of the handle 8 and has a light transmitting protective cap.

Element 11 is a indicating lamp bulb and is located in an inner hole in the exposed end of the handle.

Elements 10, 10' are conductive sheets. They are attached on the upper and lower surfaces of wedge-shaped member 9 and extend along handle 8 to indicating lamp 11. When the circuit breaker is in OFF status, the contact surfaces of conductive sheet 10 and 10' complete a circuit to lamp 11 to emit light.

The embodiment shown in FIG. 6 depicts the indicating lamp 11 at the front surface plate of the circuit breaker in a similar configuration to that of a traditional switch with an attached indicating lamp.

I claim:

1. In a circuit breaker having a manually-resettable button adapted to be extended when the breaker is tripped by an overload condition in the circuit, the improvement which comprises an indicating lamp, respective first contact elements in the breaker and connected to the circuit, and respective second contact elements carried by the button and connected to the lamp, wherein the respective first and second contact elements are engaged when the button is extended to thereby energize the lamp, wherein the first contact elements have an incline therebetween, and wherein the second contact elements have an incline therebetween of greater extent than the incline between the first contact elements, thereby assuring good electrical engagement between the first and second contact elements when the breaker is tripped.

2. In a circuit breaker having a manually-resettable button adapted to be extended when the breaker is tripped by an overload condition in the circuit, the improvement which comprises an indicating lamp, respective first contact elements normally engaged in the breaker when the breaker is not tripped and connected to the circuit, and respective second contact elements carried by wedge means on the button and connected to the lamp, wherein the respective first and second contact elements are engaged by said wedge means when the button is extended to thereby energize the lamp, when the breaker is tripped, and wherein said first contact elements are disengaged by said wedge means when the breaker is tripped.

* * * * *